US007328793B2

(12) United States Patent
Leaphart, Jr. et al.

(10) Patent No.: US 7,328,793 B2
(45) Date of Patent: Feb. 12, 2008

(54) PLUNGER STORAGE UNIT

(75) Inventors: J. Kirk Leaphart, Jr., 309 SE. Main St., #205, Simpsonville, SC (US) 29681; C. Mark Leaphart, 309 SE. Main St., Suite 205, Simpsonville, SC (US) 29681; William Noack, Cincinnati, OH (US); Eugene E. Schneider, West Chester, OH (US)

(73) Assignees: J. Kirk Leaphart, Jr., Simpsonville, SC (US); C. Mark Leaphart, Simpsonville, SC (US)

( * ) Notice: Subject to any disclaimer, the term of this patent is extended or adjusted under 35 U.S.C. 154(b) by 606 days.

(21) Appl. No.: 10/847,003

(22) Filed: May 17, 2004

(65) Prior Publication Data

US 2005/0252804 A1 Nov. 17, 2005

(51) Int. Cl.
*A45D 44/00* (2006.01)

(52) U.S. Cl. ..... 206/349; 206/15.2; 206/15.3; 4/255.11

(58) Field of Classification Search ..... 206/349, 206/15.2, 15.3, 209, 361; 220/324, 254.1, 220/360, 367.1; 248/233.41, 224.7, 227.2, 248/316.7; 4/255.01, 255.11, 255.05; D6/551
See application file for complete search history.

(56) References Cited

U.S. PATENT DOCUMENTS

| | | | | | |
|---|---|---|---|---|---|
| 3,365,761 | A | * | 1/1968 | Kalvig | 248/113 |
| 4,847,939 | A | * | 7/1989 | Derencsenyi et al. | 15/246 |
| 5,114,006 | A | * | 5/1992 | Wilk | 206/349 |
| D368,820 | S | * | 4/1996 | Sander | D6/551 |
| 5,645,167 | A | * | 7/1997 | Conrad | 206/361 |
| D383,935 | S | * | 9/1997 | Zawalsky | D6/524 |
| 5,924,566 | A | * | 7/1999 | Gibbs | 206/361 |
| 5,940,897 | A | | 8/1999 | James | 4/255.02 |
| D419,019 | S | * | 1/2000 | Shafik | D6/551 |
| 6,035,456 | A | * | 3/2000 | Taylor | 4/255.11 |
| 6,038,709 | A | * | 3/2000 | Kent | 4/255.05 |
| 6,041,919 | A | * | 3/2000 | Adams | 206/15.3 |
| D450,964 | S | * | 11/2001 | Johnson | D6/524 |
| 6,484,326 | B1 | | 11/2002 | Leaphart et al. | 4/255.02 |

* cited by examiner

*Primary Examiner*—Mickey Yu
*Assistant Examiner*—Steven A. Reynolds
(74) *Attorney, Agent, or Firm*—Joseph T. Guy; Nexsen Pruet, LLC

(57) ABSTRACT

A plunger storage unit with a base and a cap secured to the based. The base has a handle receiving void. A handle adapter is received in the handle receiving void. The handle adapter has an inner arc and an outer arc with a land between the inner arc and outer arc. Upper tabs and lower tabs are attached to the outer arc such that when the handle adapter is in the handle receiving void a portion of the cap is between the upper tabs and the lower tabs.

22 Claims, 6 Drawing Sheets

9
11
3
10
1
5
8
7
9
6
2
4
12

PLUNGER STORAGE UNIT

RELATED APPLICATIONS

The present application claims priority to pending U.S. patent application Ser. No. 10/739,417 filed Dec. 18, 2003 which claims priority to pending U.S. patent application Ser. No. 10/436,515, filed May 13, 2003 which, in turn, claims priority to pending U.S. patent application Ser. No. 10/322,920, filed Aug. 22, 2002 which, in turn, claims priority to U.S. patent application Ser. No. 09/850,275, filed May 7, 2001, now U.S. Pat. No. 6,484,326.

BACKGROUND OF THE INVENTION

The present invention is related to a storage unit for plungers and the like. More particularly, the present invention is related to a convenient plunger storage unit which is economically manufactured and which can accept multiple plunger types.

Plungers are well known commercially available items found in most homes. Plungers serve the function of applying some type of force to a clogged drain such that the force displaces the clog allowing the drain to flow freely. Most plungers have a handle and either a bell or some other volume displacement mechanism.

One common problem with plungers is storage. It would be readily apparent that plungers are unsanitary owing to their use in clogged toilets, sinks and the like. Furthermore, plungers are typically wet with unsanitary water. There has been a long-standing desire for a plunger storage unit which is capable of trapping drippings from a plunger and which is aesthetically pleasing.

A particular problem with plunger storage is the wide variety of sizes, shapes and configurations. Previously a storage unit would only house a limited number of plunger designs. This led to a proliferation of plunger storage units none of which were very successful since the market for each was limited. There has been a long-felt need for a plunger storage unit which can be easily modified, by the eventual consumer, to fit multiple and diverse plungers.

SUMMARY OF THE INVENTION

It is an object of the present invention to provide a plunger storage unit which can be manufactured economically and which stores plungers of multiple designs.

It is another object of the present invention to provide a plunger storage unit which traps drippings from the plunger.

A particular feature of the present invention is the simplicity of modification allowing the plunger to meet the demands of a diverse selection of commercially available plungers.

These and other advantages, as will be realized, are provided in a plunger storage unit. The plunger storage unit has a base and a cap secured to the based. The base has a handle receiving void. A handle adapter is received in the handle receiving void. The handle adapter has an inner arc and an outer arc with a land between the inner arc and outer arc. Upper tabs and lower tabs are attached to the outer arc such that when the handle adapter is in the handle receiving void a portion of the cap is between the upper tabs and the lower tabs.

Yet another embodiment is provided in a plunger storage unit. The plunger storage unit has a base comprising a ledge, a downwardly sloping seat interior to the ledge and a reservoir interior to the downwardly sloping seat. A cap is attached to the based wherein the base has a handle receiving void. A handle adapter is received in the handle receiving void. The handle adapter has an inner arc and an outer arc with a land between the inner arc and outer arc. Upper tabs and lower tabs are attached to the outer arc wherein when the handle adapter is in the handle receiving void a portion of the cap is between the upper tabs and lower tabs.

DETAILED DESCRIPTION OF THE INVENTION

The present invention will be described with reference to the various figures forming an integral part of the disclosure. The figures are intended to illustrate, not limit, the invention. In the various figures similar elements will be numbered accordingly.

Figure 2:
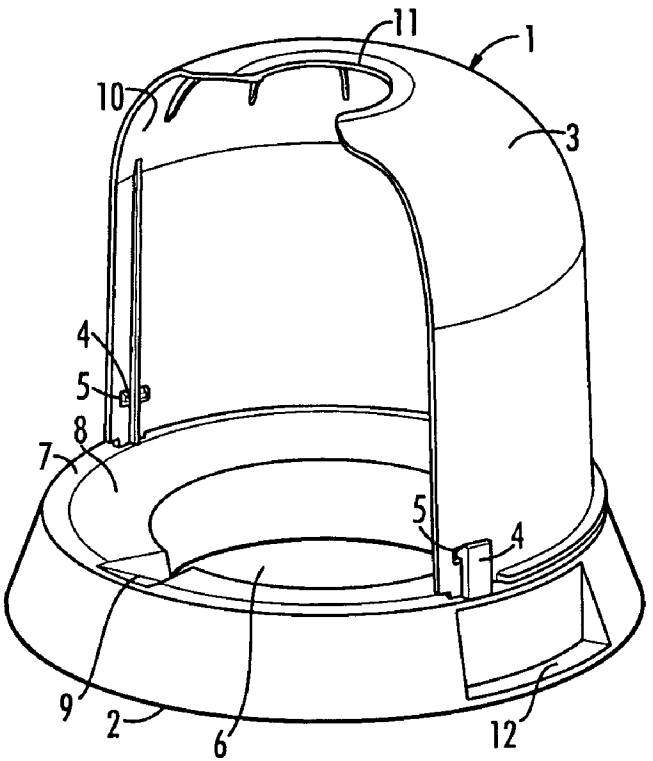
FIG. 2 is a perspective view of the embodiment of FIG. 1 as assembled.
Figure 1:
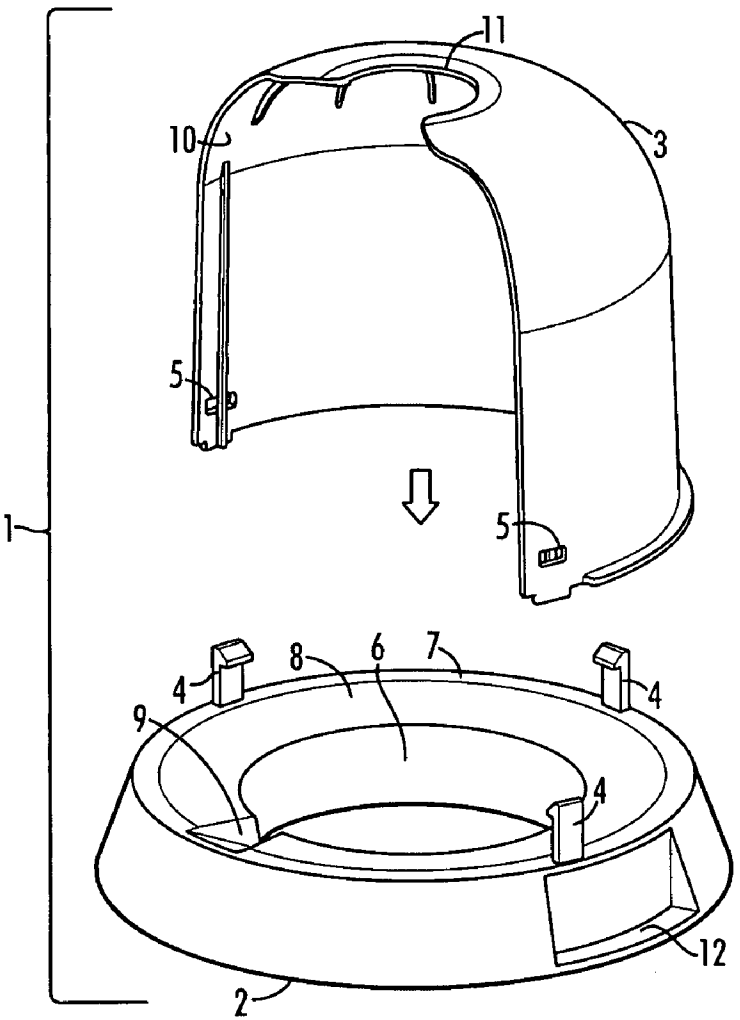
FIG. 1 is an exploded perspective view of an embodiment of the present invention.
Figure 3:
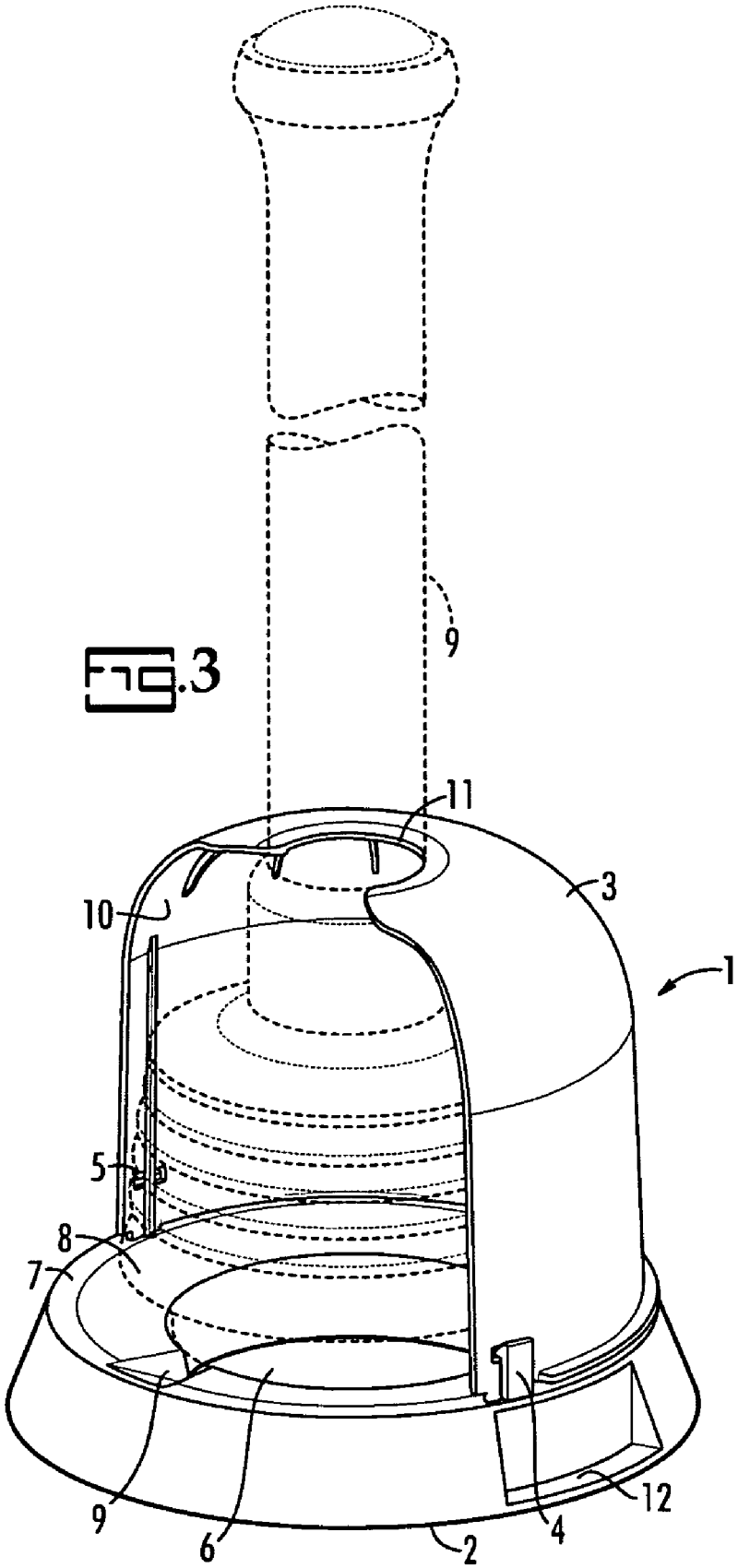
FIG. 3 illustrates the embodiment of FIGS. 1 and 2 in perspective view as used with a large handled plunger.

An exploded perspective view of an embodiment of the present invention is illustrated in FIG. 1 with the assembled view illustrated in FIG. 2. FIG. 3 illustrates the embodiment of FIGS. 1 and 2 as used with a plunger.

The plunger storage unit, generally represented at 1, comprises a base, 2, and cap, 3. The base, 2, comprises a multiplicity of tabs, 4, which are received by voids, 5, to reversibly secure the cap to the base. The tabs are preferably located on a ledge, 7. Interior to the ledge, 7, is a downwardly sloping seat, 8, upon which the plunger, 9, rest during storage. The downwardly sloping seat, 8, allows any drippings from the exterior of the plunger to flow downward in to a centrally located reservoir, 6, wherein drippings are captured. A pour spout, 9, forms a channel from the reservoir to the ledge, 7, whereby upon tipping the plunger storage unit the captured drippings are poured from the unit. An indention, 12, preferably on either side, provides a convenient exterior location for one to place a foot to stabilize the unit while removing and replacing the plunger.

The cap, 7, is preferably a portion of a generally cylindrical shape although other shapes can be employed. The cap forms a cavity with the base within which the plunger resides during storage. The cap has an open end, 10, wide enough to pass the plunger there through. In practice, the cap is preferably about 180° to 240° of the arc of an equivalent cylinder with the remaining portion representing the open end. If the cap is less than about 180° of the arc of an equivalent cylinder the structural stability is compromised. If the cap is more than about to 240° of the arc of an equivalent cylinder the open end, 10, is to small to allow plungers to be easily received. Most preferably the cap is about 210° of the arc of an equivalent cylinder with the remaining portion representing the open end.

At the upper end of the cap, 2, is a handle receiving void, 11. The handle receiving void, 11, receives the handle of the plunger thereby securing the plunger in the unit. The handle receiving void, 11, is preferably arcuate. The handle receiving void preferably represents more than about 180° of an equivalent circle. In practice, the handle is pressed into the handle receiving void causing the cap around the void to slightly distort to receive the handle. After receiving the handle the cap returns to rest position thereby securing the handle in the handle receiving void. If the handle receiving void is not more than about 180° of an equivalent circle the handle does not cause the cap to distort upon entry and is therefore not secured. The handle receiving void is preferably less than about 270° since the cap may be incapable of distorting to a degree sufficient to allow the handle to be grasped adequately. It is most preferred that the handle receiving void represent about 240° of an equivalent circle.

Figure 4:
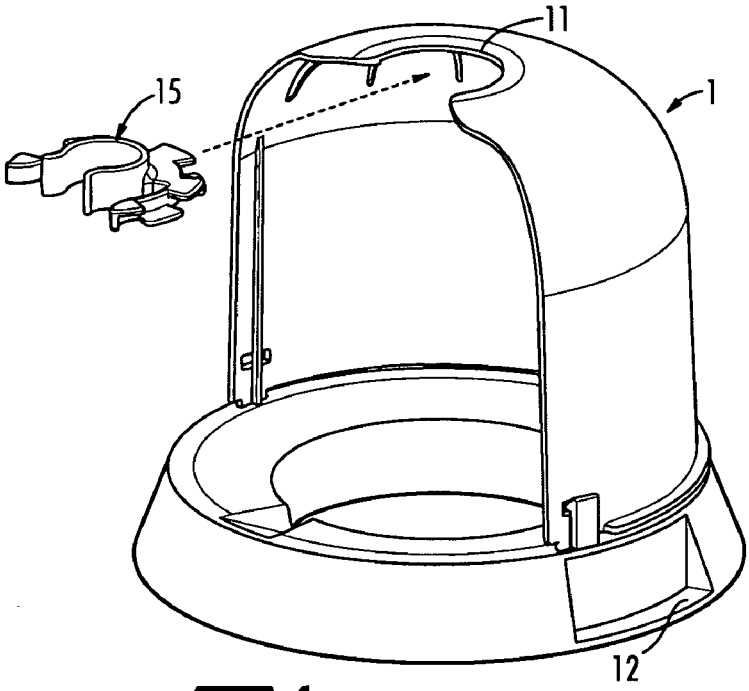
FIG. 4 is a partially exploded perspective view of another embodiment of the present invention.
Figure 5:
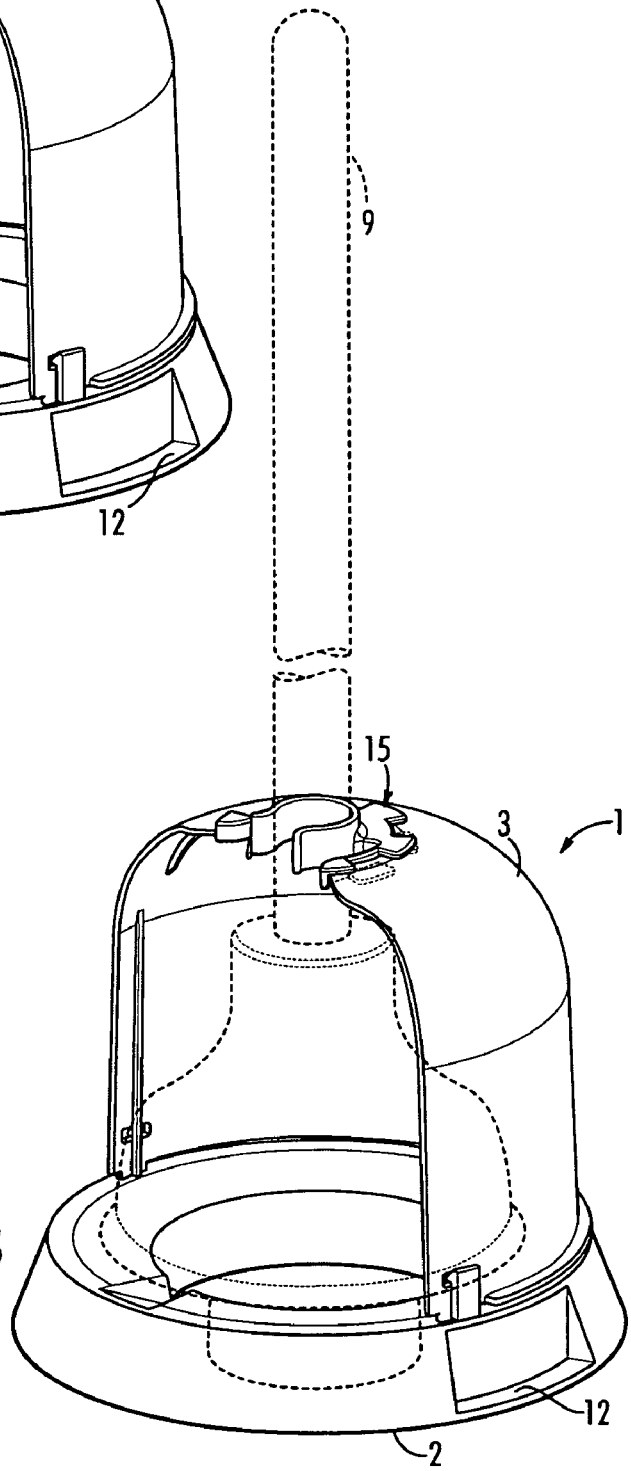
FIG. 5 is a perspective view of the embodiment of FIG. 4 as assembled and used with a small handled plunger.

Another embodiment of the present invention is illustrated in FIGS. 4 and 5. In FIGS. 4 and 5 the base, 2, and cap, 3, are as described relative to FIGS. 1-3. A handle adapter, 15, is received by the handle receiving void to allow for a plunger, 9, with a smaller handle to be secured within the plunger storage unit. The handle adapter, 15, will be described in more detail relative to FIGS. 6 and 7.

Figure 6:
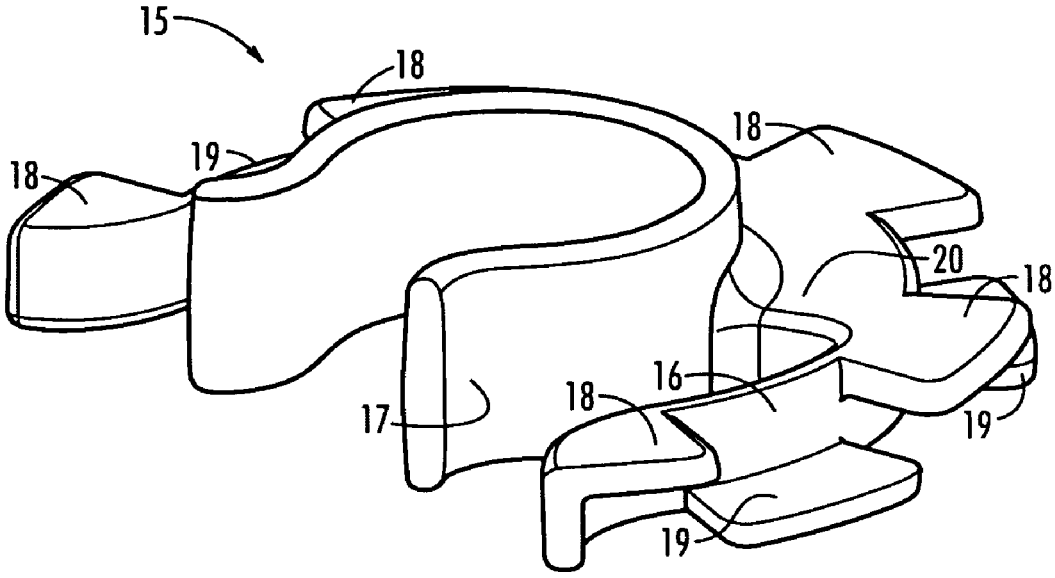
FIG. 6 is a perspective view of the adapter clip of the present invention.
Figure 7:
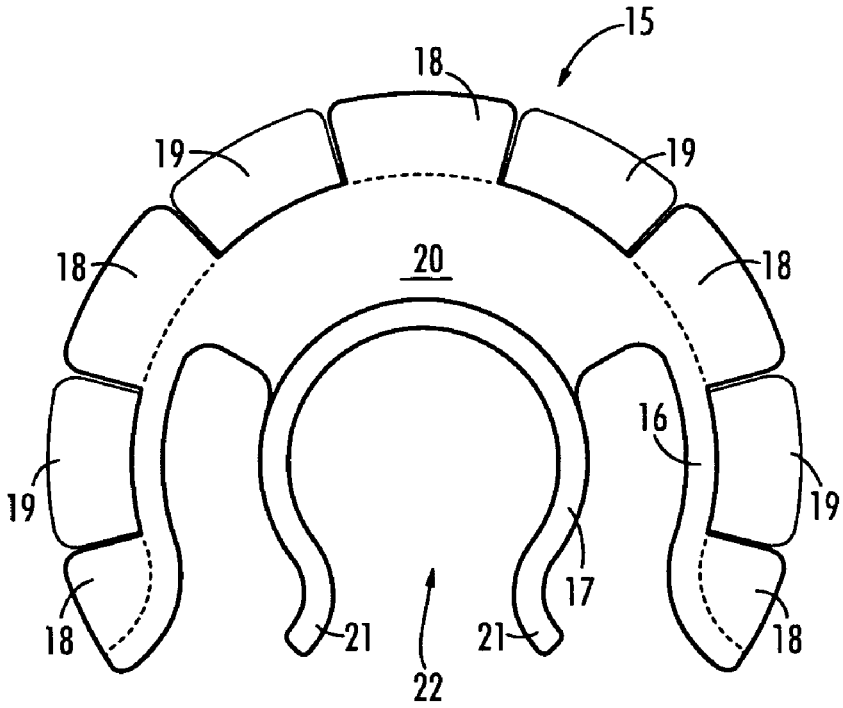
FIG. 7 is a top view of the adapter clip of FIG. 6.

A handle adapter, 15, is illustrated in perspective view in FIG. 6 and top view in FIG. 7. The handle adapter, 15, comprises an outer arc, 16, and an inner arc, 17, with a land, 20, connecting the two arcs. The outer arc, 16, comprises upper tabs, 18, and lower tabs, 19. In use the outer arc is received by the handle receiving void, 11, of the cap, 2, with the upper tabs, 18, exterior to the unit and the lower tabs, 19, interior to the unit. The handle adapter, 15, is therefore received in a manner consistent with a plunger handle as described relative to FIGS. 1-3. The inner arc, 17, is analogous to the handle receiving void and, in fact, receives the handle of a plunger as illustrated in FIG. 5. The outer arc is preferably approximately the same size, or slightly smaller, than the handle receiving void to insure adequate fit. The inner arc is preferably arcuate with outwardly projecting tabs, 21, at the end of the arc to form a receiving channel, 22.

Figure 8:
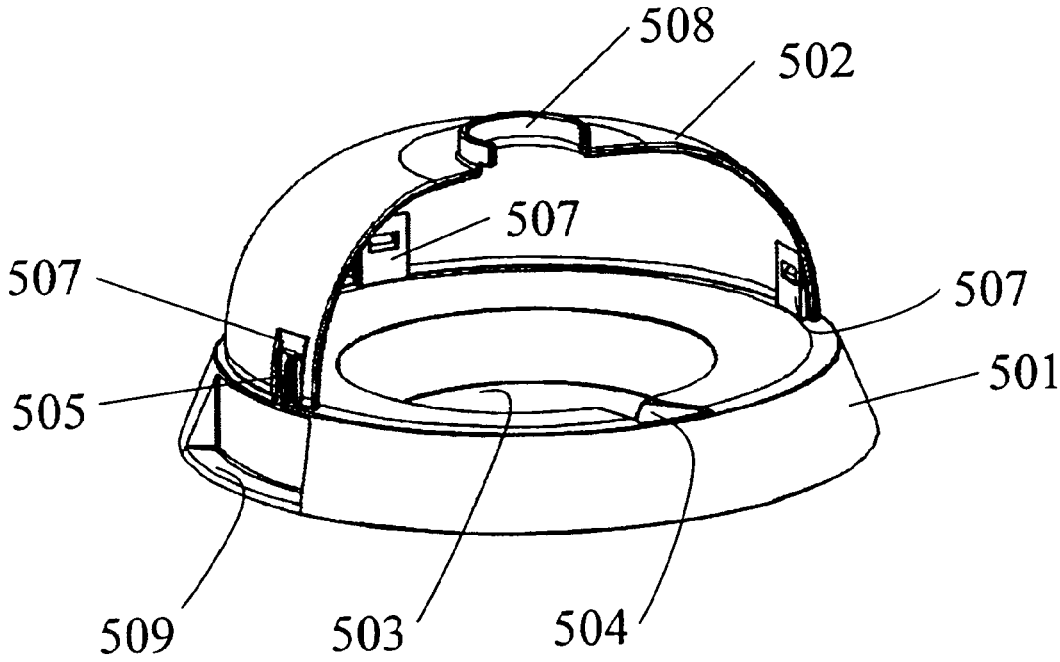
FIG. 8 is an exploded view of an embodiment of the present invention.
Figure 9:
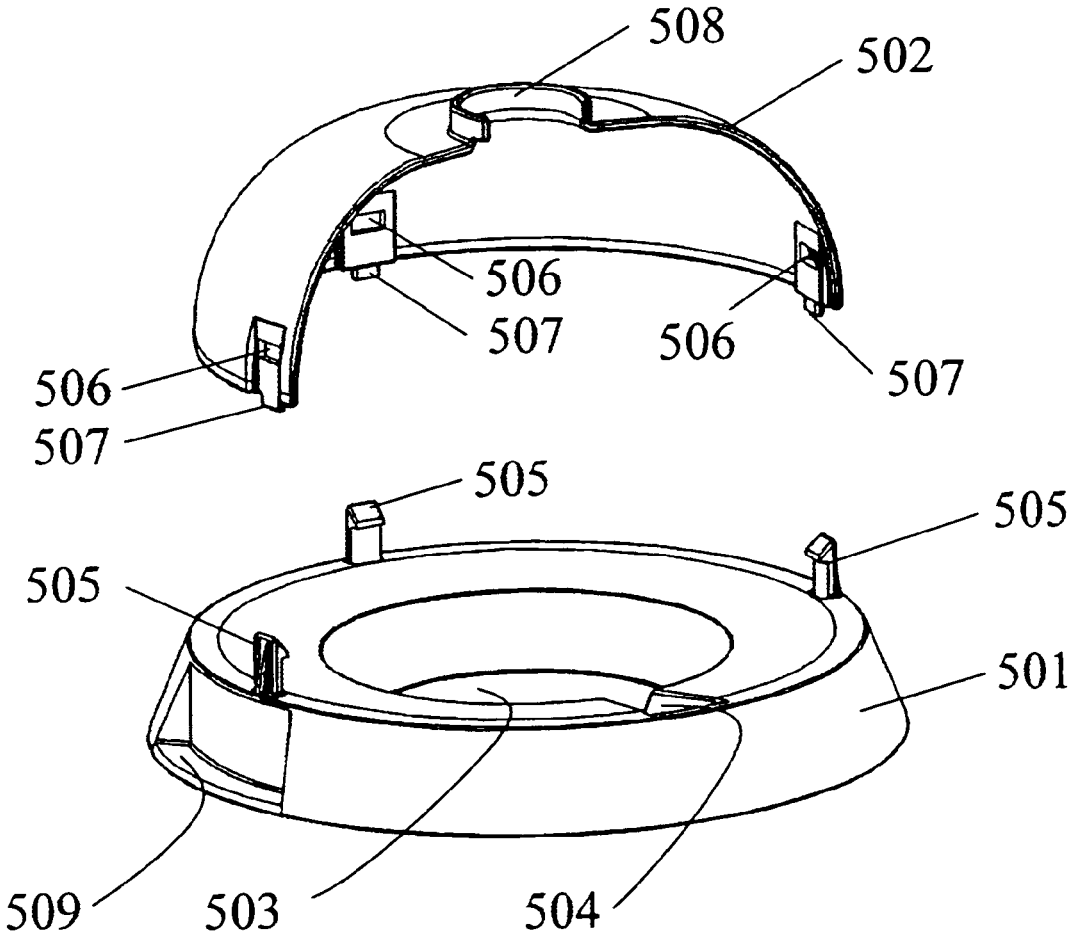
FIG. 9 is a perspective view of the embodiment of FIG. 8 as viewed when assembled.

An embodiment of the holder is illustrated in exploded perspective view in FIG. 8 and as assembled in perspective view in FIG. 9. The holder has a substantially disk shaped base, 501. A substantially hemispherical top cover, 502, attaches to the base by snap fit wherein a connection tab in the form of a protrusion on stud, 505, mates with a void, 506, in recess, 507. The base, 501, preferably comprises an inwardly angled well, 503, wherein any dripping liquid may be collected. A pour spout, 504, allows any liquid captured in the well to be easily disposed of. A lower recess, 509, provides a location for one to place a foot to stabilize the holder when the plunger is removed and inserted. A semicircular handle adapter, 508, receives a portion of the plunger to stabilize the plunger in the holder.

The cap could also comprise a multiplicity of tabs which mate with voids in the base.

The present invention has been described with reference to the preferred embodiments. The invention is more specifically set forth in the claims appended hereto.

The invention claimed is:

1. A plunger storage unit comprising:

a base;

a cap secured to said base wherein said cap comprises a handle receiving void; and a handle adapter received in said handle receiving void comprising:

an inner arc and an outer arc with a land between said inner arc and said outer arc;

upper tabs attached to said outer arc and lower tabs attached to said outer arc wherein when said handle adapter is in said handle receiving void a portion of said cap is between said upper tabs and said lower tabs wherein said base further comprises a reservoir wherein said base further comprises a pour spout.

2. The plunger storage unit of claim 1 wherein said handle adapter further comprises outwardly projecting tabs at the terminus of said arc.

3. The plunger storage unit of claim 1 wherein said handle receiving void is an arc of more than 180° of an equivalent circle.

4. The plunger storage unit of claim 3 wherein said handle receiving void is an arc of less than 270° of an equivalent circle.

5. The plunger storage unit of claim 4 wherein said ledge comprises at least one connection tab.

6. The plunger storage unit of claim 5 wherein said cap comprises a void for receiving said connection tab.

7. A plunger storage unit comprising:

a base;

a cap secured to said base wherein said cap comprises a handle receiving void; and a handle adapter received in said handle receiving void comprising:

an inner arc and an outer arc with a land between said inner arc and said outer arc;

upper tabs attached to said outer arc and lower tabs attached to said outer arc wherein when said handle adapter is in said handle receiving void a portion of said cap is between said upper tabs and said lower tabs wherein said handle receiving void is an arc of more than 180° of an equivalent circle.

8. The plunger storage unit of claim 7 wherein said handle receiving void is an arc of less than 270° of an equivalent circle.

9. A plunger storage unit of claim 7 wherein said base comprises a ledge, a downward sloping seat extending inward from said ledge and a reservoir interior to said downward sloping seat.

10. The plunger storage unit of claim 9 wherein said ledge comprises at least one connection tab.

11. The plunger storage unit of claim 10 wherein said cap comprises a void for receiving said connection tab.

12. The plunger storage unit of claim 7 wherein said base further comprises an exterior indentation.

13. The plunger storage unit of claim 12 wherein said base further comprises a pour spout between said reservoir and said ledge.

14. The plunger storage unit of claim 7 wherein said handle adapter further comprises outwardly projecting tabs at the terminus of said arc.

15. A plunger storage unit comprising:

a base comprising:

a stud with a protrusion attached to said base; and a reservoir in said base; and a cover for said base comprising:

a void for receiving said protrusion; and a handle receiving void further comprising a handle adapter in said handle receiving void.

16. The plunger storage unit of claim 15 wherein said handle adapter comprises:

an inner arc and an outer arc with a land between said inner arc and said outer arc;

upper tabs attached to said outer arc and lower tabs attached to said outer arc wherein when said handle adapter is in said handle receiving void a portion of said cap is between said upper tabs and said lower tabs.

17. The plunger storage unit of claim 15 wherein said base further comprises a pour spout.

18. The plunger storage unit of claim 15 wherein said handle receiving void is an arc of more than 180° of an equivalent circle.

19. The plunger storage unit of claim 18 wherein said handle receiving void is an arc of less than 270° of an equivalent circle.

20. A plunger storage unit of claim 15 wherein said base comprises a ledge, a downward sloping seat extending inward from said ledge and said reservoir is interior to said downward sloping seat.

21. The plunger storage unit of claim 20 wherein said ledge comprises at least one connection tab.

22. The plunger storage unit of claim 15 wherein said base further comprises an exterior indentation.

* * * * *

UNITED STATES PATENT AND TRADEMARK OFFICE

CERTIFICATE OF CORRECTION

PATENT NO. : 7,328,793 B2
APPLICATION NO. : 10/847003
DATED : February 12, 2008
INVENTOR(S) : Leaphart, Jr. et al.

It is certified that error appears in the above-identified patent and that said Letters Patent is hereby corrected as shown below:

In col. 2, Line 24 delete “exploded” and replace with --perspective--

In col. 2, Line 26 delete “a perspective” and replace with --an exploded--

In col. 3, Line 44 delete “exploded”

In col. 3, Line 45 delete “perspective” and replace with --exploded--

Signed and Sealed this

Thirteenth Day of May, 2008

JON W. DUDAS
*Director of the United States Patent and Trademark Office*